United States Patent [19]

Conklin

[11] 3,989,155

[45] Nov. 2, 1976

[54] INVERTABLE FUEL TANK

[75] Inventor: Richard H. Conklin, Greenwich, Conn.

[73] Assignee: Lawrence Peska Associates, Inc., New York, N.Y. ; a part interest

[22] Filed: Feb. 6, 1976

[21] Appl. No.: 655,677

[52] U.S. Cl. ..... 220/1 B; 220/18; 220/69; 220/85 R

[51] Int. Cl.[2] ..... B65D 25/24; B65D 7/40

[58] Field of Search ..... 220/1 B, 5 R, 5 A, 18, 220/69, 85 R; 248/151, 188, 188.4, 188.8

[56] References Cited

UNITED STATES PATENTS

| | | | |
|---|---|---|---|
| 1,866,979 | 7/1932 | Lerid | 220/5 R |
| 1,909,028 | 5/1933 | Waite | 220/69 X |
| 2,009,606 | 7/1935 | Diffenderfer | 220/1 B |
| 2,071,811 | 2/1937 | Bartuska et al. | 220/85 R X |
| 2,531,159 | 11/1950 | Rowell | 220/1 B |
| 2,557,461 | 6/1951 | Paulsen | 220/85 R |
| 2,780,922 | 2/1957 | Johannesen | 220/5 A X |
| 3,028,918 | 4/1962 | Huthsing, Sr. | 220/5 A X |
| 3,050,207 | 8/1962 | Oxenham | 220/69 X |
| 3,160,171 | 12/1964 | Klein | 220/69 X |

*Primary Examiner*—George E. Lowrance
*Assistant Examiner*—Stephen Marcus
*Attorney, Agent, or Firm*—Jack D. Slobod

[57] ABSTRACT

A tank body has groups of threaded apertures through the wall of the tank arranged in identical patterns on top and bottom portions thereof. A filler pipe, gauge, vent and outlet pipe may be installed in the apertures on either the top or bottom of the tank for allowing the tank to be utilized in either an upright or inverted orientation. Removable plugs are provided for unused apertures and threaded sockets are formed on the top and bottom portions for selectively receiving legs.

1 Claim, 5 Drawing Figures

INVERTABLE FUEL TANK

FIELD OF THE INVENTION

The present invention relates generally to fuel tanks such as used for heating oil. In its particular aspects, the present invention relates to the provision of identical patterns of ports on the top and bottom of the tank to enable the tank to be set up for use either upright or inverted.

BACKGROUND OF THE INVENTION

Fuel tanks such as used for heating oil have a somewhat limited life because of water condensation within the tank rusting or corroding the tank wall to destroy the integrity thereof. This typically occurs in summer conditions where a fuel tank may be empty for several months and the condensed water collects at the bottom of the tank to rust a hole in the tank bottom. The bottom of the tank is also vulnerable to failure because it must withstand the greatest fluid pressure when the tank is full.

Since the greatest stress occurs at the bottom of a fuel oil tank, the life of the tank would be increased if after some period of time, somewhat less than the usual expected life of the tank, the tank could be actually inverted and set up for operation in this inverted condition.

OBJECTS OF THE INVENTION

It is an object of the present invention to provide a fuel tank having an identical series of ports on its top and bottom whereby the tank may be utilized either upright or inverted.

It is a further object of the present invention to provide a fuel tank configured to be utilized either inverted or upright whereby the tank may be inverted after a period of time for increasing its life.

It is yet another object of the present invention to provide a fuel tank having means both at the top and bottom of the tank for selectively securing legs thereto.

SUMMARY OF THE INVENTION

Briefly, the aforementioned and other objects of the present invention are satisfied by providing a tank body defined by identical top and bottom portions. First and second groups of threaded apertures through the tank wall are respectively provided on the top and bottom portions in identical patterns. This enables the tank body to be utilized in either an upright or inverted orientation by installing a filler pipe, vent and guage in the apertures at the top of the tank and an outlet pipe in one of the apertures at the bottom of the tank. Removable plugs are provided for the unused apertures and identical sockets are formed on the top and bottom portions of the tank for selectively receiving leg members.

Thus, the tank may be utilized in an upright orientation for a period of time approaching the expected life of the tank. Thereafter, the tank may be inverted for increasing its life, and the filler pipe, vent, guage, and outlet pipe may be relocated to formerly unused apertures of the inverted tank.

Other objects, features and advantages of the present invention will become apparent upon perusal of the following detailed description of the preferred embodiment thereof wherein.

DETAILED DESCRIPTION

Figure 1:
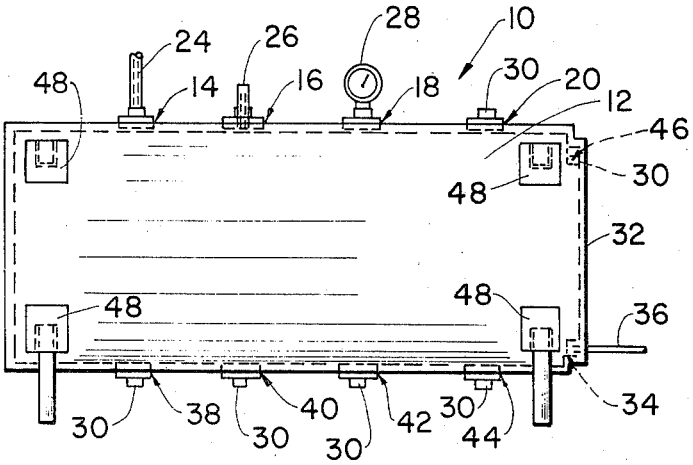
FIG. 1 is a side elevational view of an oil tank according to the present invention.
Figure 2:
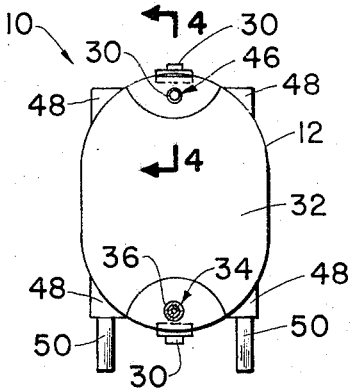
FIG. 2 is a front elevational view of the oil tank in FIG. 1.
Figure 3:
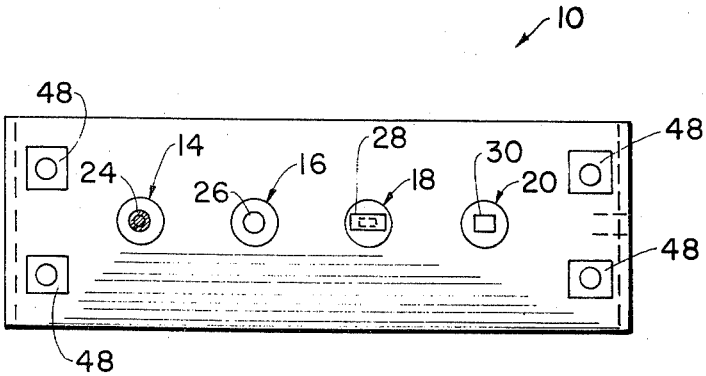
FIG. 3 is a top view of the oil tank.
Figure 4:
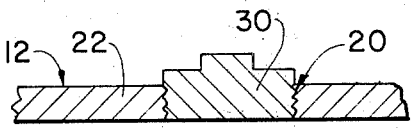
FIG. 4 is a fragmentary cross-sectional view through the lines 4—4 in FIG. 2.
Figure 5:
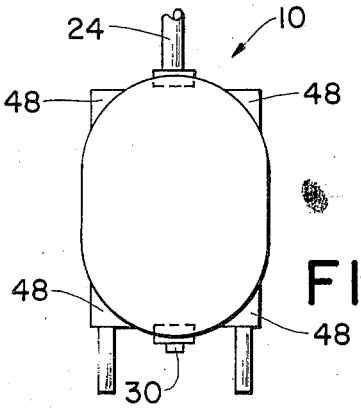
FIG. 5 is a rear elevational view of the oil tank.

Referring to FIGS. 1 through 5 of the drawing, the oil tank apparatus of the present invention is generally indicated by the reference numeral 10. Apparatus 10 includes a standard 275 gallon capacity horizontally elongated substantially cylindrical tank body 12 of substantially uniform wall thickness. Four two inch diameter threaded apertures or ports 14, 16, 18 and 20 through the wall 22 of tank body 12 are provided longitudinally spaced apart in the usual configuration. The ports 14, 16 and 18 respectively threadably receive a filler pipe 24, an air vent 26, and an oil level guage 28 as is conventional. Port 20, is an auxiliary port for duplex connections, and is conveniently sealed with a threaded plug 30 when not used. Further, the front wall 32 of tank body 12 has a threaded aperture or port 34 formed at its bottom for threadably receiving an outlet pipe 36 in the usual manner.

According to the principles of the present invention, additional threaded apertures or ports 38, 40, 42, 44 and 46 are provided at diametrically opposite positions to the apertures or ports 24, 26, 28, 30 and 34 enable the tank body 12 to appear identical when inverted. Thus, ports 38–44 are provided through the tank wall 20 on the bottom of the tank in an identical pattern or spacing to the ports 14 or 20 on the top of tank. Further, the port 46 is located at the top of the tank front 34. Each of the ports 38–46 are sealed with a removable threaded plug 30.

It should be appreciated that the tank may be utilized as illustrated in FIG. 1 for a period of time approaching the expected life, such as 8 years. Then the tank body 12 is rotated 180° about its axis to invert the tank body. The filler pipe 24, vent 26 and guage 28 are relocated to the ports 38–42 which are then at the top by removing plugs 30 and utilizing them to seal ports 14–18. Similarly, the outlet pipe 36 and plug 30 are exchanged in the ports 34, 46. Thus the tank apparatus 10 effectively has a new bottom allowing it increased life.

The tank body 12 further carries identical patterns of threaded sockets 48 on the top and bottom of the body for selectively threadably receiving legs 50. Thus, the legs 50 may be selectively located for supporting the tank body 12 in its either upright or inverted orientation.

While the preferred embodiment of the present invention has been described in specific detail, it should be noted that numerous modifications, additions and omissions in the details thereof are possible within the intended spirit and scope of the invention claimed herein.

What is claimed is:

1. An invertable fuel tank comprising: a tank body having top and bottom portions; a first group of threaded apertures through the wall of said tank on said top portion for operatively receiving a filler pipe, vent and guage, said first group of apertures being arranged in a predetermined pattern; a second group of threaded apertures through the wall of said tank on said bottom portion also being arranged in said predetermined pattern, one aperture of said second group being located for receiving an outlet pipe; removable plug means for unused apertures of said first and second groups; a plurality of legs; and first and second groups of sockets respectively carried by said top and bottom sides for removably receiving said legs whereby said tank may be utilized in either an upright or inverted orientation.

* * * * *